United States Patent [19]

Mackal

[11] 4,267,944

[45] May 19, 1981

[54] AUTOMATIC INFLATOR

[76] Inventor: Glenn H. Mackal, Buena Vista Dr., Ringwood, N.J. 07456

[21] Appl. No.: 931,432

[22] Filed: Aug. 7, 1978

[51] Int. Cl.[3] ..... B63C 9/24

[52] U.S. Cl. ..... 222/5; 9/318

[58] Field of Search ..... 222/5, 54; 9/314, 316, 9/317, 318, 319, 320, 323, 324, 9; 141/38, 329

[56] References Cited

U.S. PATENT DOCUMENTS

| | | | |
|---|---|---|---|
| 2,919,833 | 1/1960 | Wolshin | 9/319 X |
| 3,757,371 | 9/1973 | Martin | 9/316 |
| 3,997,079 | 12/1976 | Niemann | 9/318 |

*Primary Examiner*—Sherman D. Basinger
*Attorney, Agent, or Firm*—Klein & Vibber

[57] ABSTRACT

There is disclosed an inflator for the inflation of inflatable articles such as life vests and the like, such inflator being operated automatically upon being subjected to water as upon the ditching or parachuting of an aviator wearing a life vest provided with such inflator. In the preferred embodiment of the inflator disclosed, the automatically operating portion of it is embodied as an attachment to a known manually operated inflator, the resulting inflator being capable of operation both manually and automatically. The automatically operating portion of the inflator incorporates a latch which holds a plunger operated by a coil compression spring in cocked condition until the latch releases the plunger, which thereafter thrusts a piercing pin against and through the sealing diaphragm of a gas-containing capsule. The latch is provided with a water-destructible member which retains the latch in plunger cocking position until the water-destructible member is subjected to water in an amount sufficient to weaken it so that the latch releases the plunger. The inflator is particularly characterized by the fact that only the latch needs to be replaced after operation of the automatic inflator, and that the coil compression spring can be compressed to cock the plunger by a wholly manual operation.

13 Claims, 6 Drawing Figures

Fig. 1
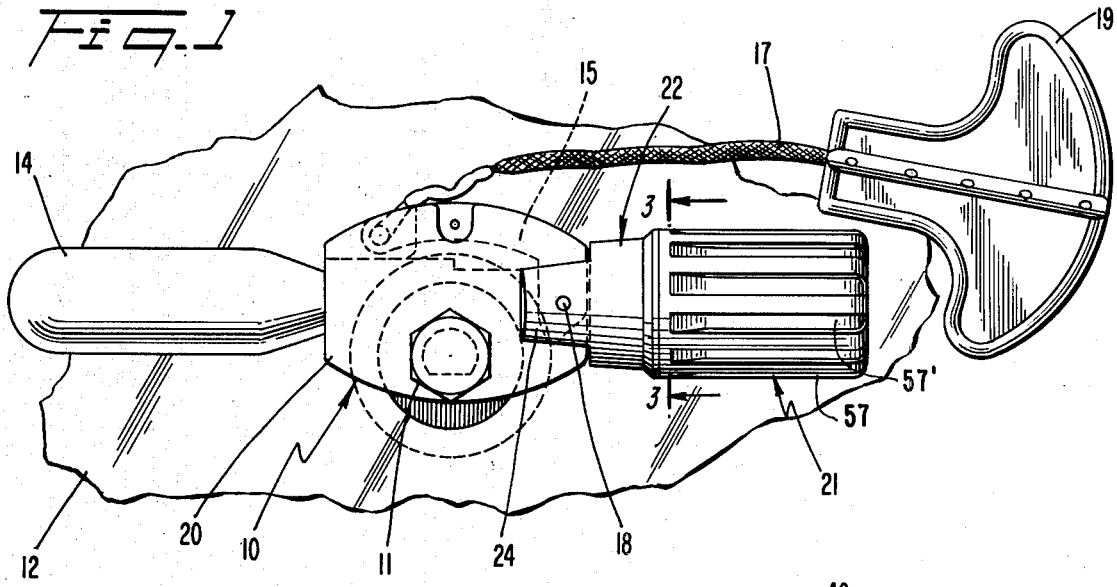
Fig. 2
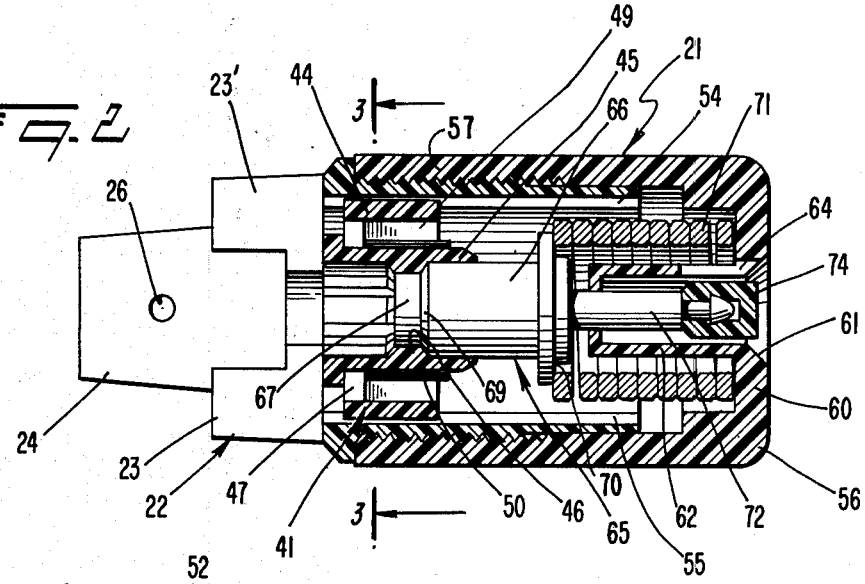
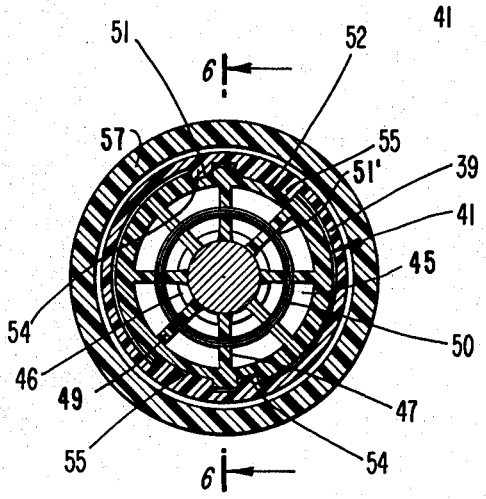
Fig. 3
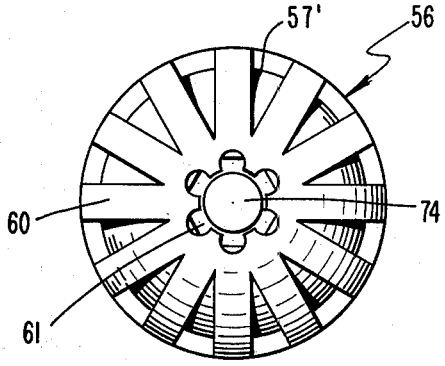
Fig. 4

AUTOMATIC INFLATOR

This application is related to the applications of

Glenn H. Mackal, Ser. No. 930,035, filed Aug. 1, 1978; and

Glenn H. Mackal, Ser. No. 931,271, filed Aug. 4, 1978 now U.S. Pat. No. 4,223,805, each of which is incorporated by reference herein in its entirety.

This application relates to an automatic inflator for inflatable articles such as life vests and the like. In the disclosed preferred embodiment thereof, the inflator is capable of operation both manually and automatically, the automatically operating portion of the apparatus being preferably embodied as an attachment to a previously known manually operated inflator, the resulting, combined device retaining its ability to be operated manually while adding the capability of being operated automatically upon its subjection to water as being submerged therein when employed with a life vest work by a ditching or parachuting aviator.

Automatic inflators have been previously proposed. Among such prior disclosed automatic inflators are the following:

Muller, U.S. Pat. No. 1,329,990;
Spidy, U.S. Pat. No. 2,894,658;
Waters, U.S. Pat. No. 3,242,514;
Fujimoto, U.S. Pat. No. 3,494,506; and
Niemann, U.S. Pat. No. 3,997,079.

Of these, only Fujimoto and Niemann disclose automatic inflators which are also capable of operation manually. In Fujimoto a lever-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary nor desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, and remains therein when the first part of the housing is removed and the inflator is operated only manually. Further, the removal of the first housing part leaves the second housing part in open condition, vulnerable to its being fouled both by physical and atmospheric agencies.

It is among the objects of the present invention to overcome the outlined disadvantages of the prior art and to provide an automatically operated mechanism, responsive to being immersed in water, to effect the piercing of a gas containing capsule, which in a preferred embodiment thereof, may be easily attached to and held securely as a part of a manually operable inflator which by itself is complete and presents a substantially closed outline. The automatic inflator of the invention may be either supplied to the trade as a separate item, which can be easily attached to existing manually-operated inflators, or the combined automatic mechanism and the manually-operated inflator may be assembled and sold as a unit.

The manual inflator of the combined manual and automatic inflator disclosed herein remains the same as it is in Mackal application Ser. No. 931,271, filed Aug. 4, 1978. The intermediate, cross-slotted plunger of the present invention is the same as that disclosed in Mackal application Ser. No. 931,271, filed Aug. 4, 1978. The housing of the automatic inflator portion of the combined inflator in the present invention is generally the same as that in Mackal application Ser. No. 931,271, filed Aug. 4, 1978, and it is attached to the body of the manual inflator in the same manner.

The inflator of the present invention employs a longer threaded engagement between the body of the automatic inflator and the skirt of the cap, permitting the threads to be caught so that the cap is installed on the body before subjecting the coil compression spring of the automatic inflator to any appreciable compression. This permits the device to be stored without subjecting the wound paper coil to any appreciable stresses before use, and allowing the user of the device himself to cock the automatic inflator rather than requiring it to be cocked at the factory.

The latching means employed in the present invention is reversed in location. It no longer abuts against the closed end of the cap as in Mackal application Ser. No. 931,271, filed Aug. 4, 1978, but is now disposed at the axially inner end of the skirt of the cap.

The latching means with the water-destructible ring therein is replaceable. In fact, it is the only thing which needs to be replaced after the automatic inflator has been used.

There is provided at least one set of mating polarizing ribs and grooves on the latching mass and the body of the automatic inflator which prevents an upside-down mounting of the latching means in the body of the automatic inflator.

The cap, plunger, and spring are secured together as a unit by snapping a plastic cap on the outer end of the stem of the plunger. Thus, when the cap is removed from the body of the automatic inflator, all of such parts remain together and are not lost during the operation of removing the used latching means and installing a new one in the body of the inflator.

The reduced diameter inner end portion at the inner end of the plunger takes the place of the groove in the stem which is employed in Mackal application Ser. No. 931,271, filed Aug. 4, 1978. The use of what is in effect a one-sided groove, permits the ready removal of the latching means and its replacement in the body of the automatic inflator.

The invention will be more readily understood upon consideration of the accompanying drawings, in which:

FIG. 1 is a view in elevation of a preferred embodiment of the automatic inflator of the invention, such inflator being shown attached by a fitting to a portion of the wall of an inflatable article, the inflator shown including a prior, manually operable inflator to which there has been added a mechanism for rendering the inflator automatically operable upon being immersed in water;

FIG. 2 is a view in vertical axial section through the automatically operable portion of the inflator shown in FIG. 1, the plunger and latching means of the automatic inflator being shown in cocked condition with the spring thereof compressed;

FIG. 3 is a view in transverse section through the automatically operated portion of the inflator, the section being taken along the line 3—3 of FIG. 2;

FIG. 4 is a view in end elevation of the automatically operated portion of the inflator of the invention, the view being taken in the direction from right to left in FIG. 1;

Figure 5:
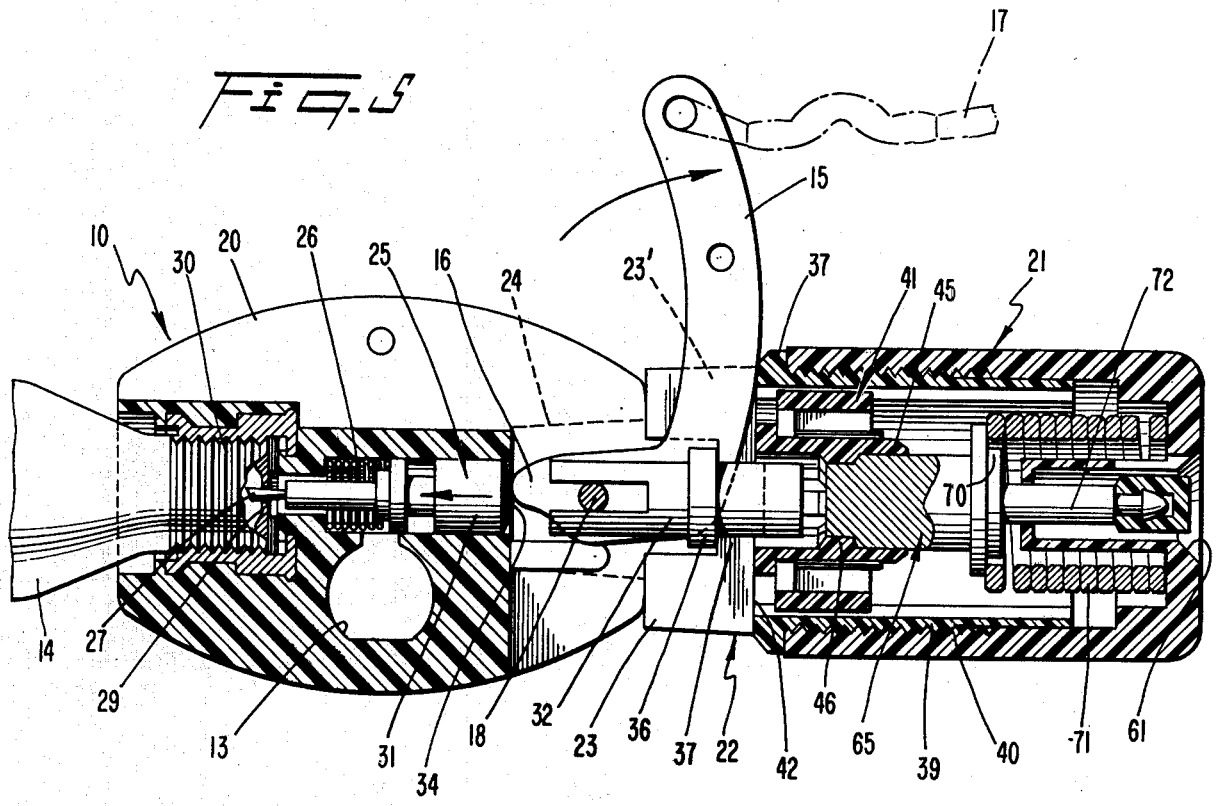
Figure 6:
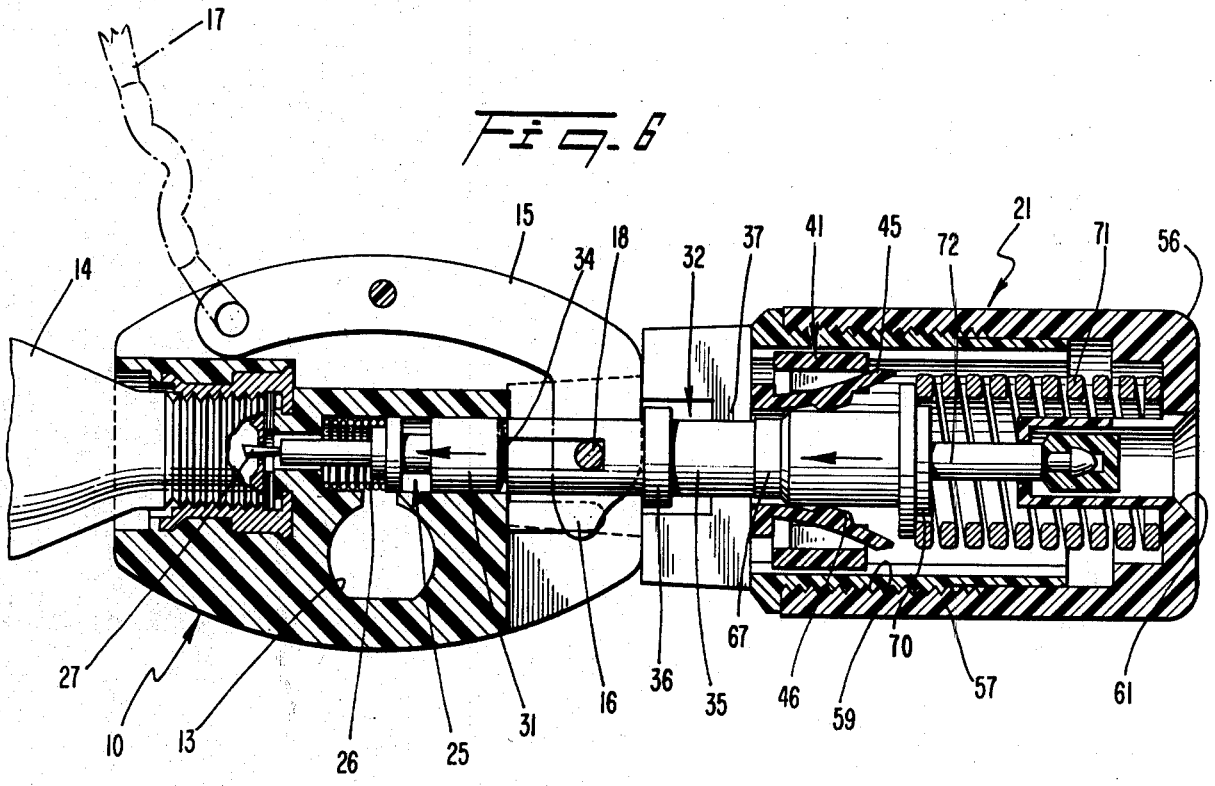

FIG. 5 is a fragmentary view, partially in side elevation and partially in vertical axial section through the combined manually operated and automatically operated inflator shown in FIG. 1, the parts thereof being shown in the position which they occupy after the manually operated portion of the inflator has been actuated; and FIG. 6 is a view similar to FIG. 5, but with the parts of the inflator in the position which they occupy after the automatically operated portion of the inflator has been actuated.

Turning now to FIG. 1, there is there shown a manually operated inflator 10 which is that shown in Mackal U.S. Pat. No. 3,809,288, May 7, 1974. Inflator 10 is attached by a fitting generally designated 11 to an inflatable article, a part of the wall of which is shown at 12. A capsule 14 containing gas such as $CO_2$ under pressure has its threaded neck 30 screwed onto the body 20 of the inflator 10 and sealed thereto. When a sealing means which spans the neck of the capsule 14 is pierced, gas is released from the capsule and flows into a chamber therein from which it is discharged through the fitting 11, which is mounted and sealed in an opening 13 in the body 20. The piercing of the capsule 14 by the manually operated inflator 10 is effected by the turning of a lever 15 by a lanyard 17 about a pivot pin 18 upon which is mounted on the body 20, thereby to cause a cam 16 integral with the lever to advance a piercing pin against and through the seal of the capsule. The lanyard 17 is provided with a handle 19 by which the lanyard may be pulled.

The automatic inflator mechanism, which is added to inflator 10, is generally designated 21. Member 21 has a circular cylindrical portion 22 from which there project to the left (FIG. 1) two parallel wings of which one is shown at 24, which are mirror images of each other and which are spaced apart a distance which only slightly exceeds the thickness of the body 20 of the inflator 10. The automatic inflator 21 is secured to the body 20 of the manual inflator 10 by the pivot pin 18, pin 18 passing through holes (one shown at 26) in the wings and through aligned holes in the body 20. When member 21 is thus mounted and held on the body 20, the members 20 and 21 are firmly and securely held together without movement between them since the flat root surface between the wings on the body 22 is firmly in engagement with the flat rear end surface of the body 20 of the manual inflator 10.

The portion 22 of the body 2 further has similar diametrically disposed slots 23, 23', the slot being disposed uppermost (FIGS. 2, 5, and 6) when the bodies 20 and 21 are assembled receiving the lever 15 as it is swung clockwise from its FIG. 1 position shown into a position somewhat past the vertical (FIG. 5) when it has advanced the piercing pin to form a hole in the sealing means of the capsule 14. The upper right-hand edge of the slot 23' (FIG. 5) forms a stop for the lever 15 in its fully swung-out position.

The piercing pin assembly of the manually operated inflator 10 is substantially the same as that disclosed and claimed in Mackal application Ser. No. 916,497, filed June 19, 1978 now abandoned. As shown in FIGS. 5 and 6, the inflator 10 has a piercing pin which is designated generally by the reference character 25, pin 25 having a larger diametered rear (right) end portion 31 with a rounded rear end surface which coacts with the surface of the cam 16. An O-ring disposed in the groove in the pin seals the pin to the longitudinal bore which it reciprocates between its inoperative (right-hand) position and that shown in FIGS. 5 and 6. A coil compression spring 26, acting on the piercing pin 25 and an annular shoulder in the passage through the body 20 constantly urges the piercing pin toward the position thereof shown in FIG. 5. Telescoped within the spring 26 is a smaller-diametered portion of the piercing pin, forwardly of which there is disposed the outer, active piercing portion 27 of the piercing pin. The cutting end 31 of portion 27 of the piercing pin confronts and is spaced from the central portion 29 of a sealing diaphragm spanning the neck of the capsule 14 when the piercing pin is in its right-hand position. When the piercing pin is moved to the left, whether by manual operation (FIG. 5) of the inflator 10 or by automatic operation (FIG. 6) by the mechanism 21, the portion 27 of the piercing pin pierces a hole in the sealing means 29 and remains protruding through such hole as shown in FIGS. 5 and 6 whether it has been moved to such position by the lever 15 or by the automatic inflation mechanism 21. Because the lever is stopped in its clockwise movement by the upper right-hand edge of the slot 23' when the manual inflator 10 is operated, the cam 16 may remain of the configuration shown in Mackal U.S. Pat. No. 3,809,288 rather than being of circular configuration beyond the high point of the cam, as in the above referred to Mackal application, Ser. No. 916,497, filed June 19, 1978.

The automatic inflation mechanism 21 includes a cross-slotted intermediate pin 32 having a forward (left) circular cylindrical portion 34, a flange or collar 36 rearwardly of portion 41, and a rear (right) end portion 35. Portion 34 of pin 32 is of such diameter as to be guidingly received within the longitudinal bore of the body 20 within which the piercing pin 23 reciprocates. In order that the pin 32 can extend inwardly within such bore far enough so that its forward end 34 engages the rear end of the piercing pin, and also so that the pin 32 can reciprocate with respect to both the pivot pin 18 and the cam carrying end of the lever 15, the pin 32 is cross-slotted as shown, a first, axially shorter slot being located in the forward portion of pin 32 and terminating at its rear end somewhat short of the flange 36, the shorter slot receiving the pivot pin 18. The second, longer slot, which is disposed at right angles to the shorter slot, extends lengthwise of the pin 32 from its forward end through the flange 36 to a point near its rear end leaving, however, an unslotted portion at its rear end. The longer slot receives the rear end of the lever 15 and the cam 16 carried thereby. As noted, the intermediate pin 32 is guided at its forward end by the longitudinal bore in the body 20. The rear end portion of pin 32 is received within a central bore in a flange 37 in the body of the automatic inflator 21. The flange or collar 36 on the pin 32, by its engagement with the flange 37, prevents the pin 32 from travelling rearwardly past the position thereof shown in FIG. 5.

Rearwardly of the portion 22 the body of the automatic inflator 21 is provided with a thin-walled sleeve 39 which is externally screw-threaded at 40. Coacting with sleeve 39 is a cap 56 having an elongated circular cylindrical skirt 57 bearing internal screw threads 59 which mate with the threads 40 on the sleeve 39. As shown in FIGS. 1 and 4, the cap 56 is externally longitudinally fluted or grooved at 57', to aid in gripping the cap when it is screwed home on the sleeve 39.

Disposed within the housing formed by the sleeve 39 and the skirt 57 is a longitudinally centrally extending plunger 65 having a large-diametered portion 66 and a smaller diametered inner end portion 67, portions 66 and 67 of the plunger being joined by a sharply inclined frusto-conical shoulder 69. The portion 67 and the shoulder 69 on the plunger cooperate with a latching mechanism 41 which, in the embodiment shown, is of substantially the same construction as that disclosed in pending prior related applications of Mackal Ser. No. 930,035, filed Aug. 1, 1978, and Mackal Ser. No. 931,271, filed Aug. 4, 1978, except for the provision of polarizing formations thereon, to be described. Latching mechanism 41 is disposed in a seat 42, the bottom of which is defined by the flange 37 on the body 21 and the periphery of which is formed by the inner wall of the sleeve 39 adjacent such flange.

Latching mechanism 41 has an outer annular body or rim 44 to the left-hand end (FIG. 2) of which there are attached a plurality of segments 45 which form an inner sleeve. Each of segments 45 bears a tooth 46, the teeth on the segments being aligned transversely of the latching mechanism and selectively cooperating with the shoulder 69 on the plunger. The segments 45 are attached at 47 to the outer annular body of the latching mechanism, the attachment 47 and the construction of the segments 45 being such that when the plunger 65 is moved to the left (FIG. 6) by the coil compression spring 71, the teeth 46 on the segments are forced radially outwardly and the larger portion 66 of the plunger is permitted to slide therethrough.

As shown in FIG. 3, between the segments forming each successive pair thereof there is disposed a thin axially and radially inwardly projecting blade or wing 49. A wound water-disintegrable band 50 is disposed between the radially inner ends of the wings 49 and the outer ends of the segments 45 within a narrow annular groove 51' presented in the outer annular body 44 of the latching mechanism.

The wound paper band 50 maintains the segments 45 of the latching mechanism in the position thereof shown in FIG. 2 until the inflator is immersed in water, whereupon the paper band 50 disintegrates thereby permitting the segments 45 to be forced apart and the plunger to travel to the left (FIG. 6) as described above.

The cap 56 is provided with a transversely extending end or cover portion 60 at its axially outer end. Portion 60 of the cap is provided with a central opening 61 therethrough, opening 61 communicating with a centrally disposed axially inwardly extending sleeve 62 integral with the cap. A coil compression spring 71 is telescoped about the tubular portion 62 of the cap and extends between a spring seat 70 on the plunger including an enlargement thereon and the inner surface of the transverse cover portion of the cap.

The plunger 66 has an axially outer end portion 72 of reduced diameter, portion 72 extending through a central opening in a radially inwardly extending annular flange on the axially inner end of sleeve 72 and slidingly and guidingly cooperating therewith. The axially outer end of stem portion 72 is provided with a snap-on member 74 which slidingly and guidingly cooperates with the inner surface of a sleeve 62 and also functions to maintain the plunger, the spring, and the cap together as a unit when the cap is removed from the body of the automatic inflator. To this end, the member 74 has an outer diameter which markedly exceeds the stem portion 72 and thus the diameter of the hole in the flange on the axially inner end of the sleeve 62. Member 71 may be made of a material having a color which is distinctively different from that of the cap 56, so that the differences in position of the plunger, as seen in FIGS. 2 and 6, may be readily ascertained by external inspection of the automatic inflator.

In order to prevent the mounting of the latching mechanism 41 in other than the position thereof shown herein, there is provided at least one set of interfitting polarizing formations on the periphery of the annular body 44 of the latching mechanism and the internal surface of the sleeve 39. In the embodiment shown herein two such sets of polarizing formations, disposed diametrically opposite each other, are provided so that the latching mechanism may be correctly assembled in the sleeve by turning such mechanism through at most 180° with respect to the sleeve. In each set of polarizing formations there is a narrow groove 51 and a wide groove 52 in the periphery of the outer annular body 44 of the latching mechanism, and a narrow land 54 and a wide land 55 on the inner wall of the sleeve 39, the narrow land 54 being received in the narrow groove 51 and the wide land 54 being received within the wide groove 52.

The axial lengths of the threads on the sleeve 39 and the skirt 57 of the cap are such that the cap can be initially screwed upon the skirt without subjecting the spring 71 to appreciable compression and thus without subjecting the water-destructible member 50 to any appreciable stress. The coil compression spring 71 has a thrusting force when fully or substantially compressed to place the plunger 66 in cocked condition such that the automatic inflator can be readily cocked manually by a person by screwing the cap 56 further upon the body of the inflator to a position such as that shown in FIG. 2.

It will be seen that, after the automatic inflator has been operated, as shown in FIG. 6, the use latching mechanism 41 can be removed from the automatic inflator simply by unscrewing the cap from the body thereof, the cap, the plunger, and the coil compression spring then being removable as a unit from the body of the automatic inflator. All that need be replaced is the latching mechanism 41, the cap, plunger, and coil compression spring then being reapplied as a unit by screwing the cap onto the sleeve of the body to an extent necessary only to catch the mating threads thereon. As above-explained, the spring 71 need be compressed only before the automatic inflator is to be placed in use.

Although the invention has been illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. In an inflator for a gas-inflatable article, said inflator having a gas capsule-holding means, a capsule-piercing pin, means including a plunger for advancing the piercing pin and capsule relatively toward each other to pierce the capsule, resilient means urging the plunger and capsule relatively toward each other, and a latching mechanism cooperating with the plunger for holding the plunger in cocked position against the thrust of the resilient means, the improvement which comprises a housing for the plunger and the latching mechanism, the housing having a body with an elongated sleeve and a transverse base portion at an axially inner end thereof, a cap with a transverse cover portion at its axially outer end and an elongated skirt extending axially inwardly from the cover portion, the sleeve and skirt being telescoped and having a threaded connection therebetween, the plunger extending longitudinally within the sleeve and skirt and having a free end terminating adjacent the base portion of the housing, the latching mechanism comprising an annular water-responsive latching unit removably received in a seat within the sleeve in the base portion of the housing, the latching unit receiving the free end of the plunger therewithin and substantially encircling said free end of the plunger, and the resilient means being interposed between a portion of the cap adjacent its axially outer end and a part of the plunger.

2. The apparatus of claim 1, wherein the capsule is held in fixed position on the inflator and the piercing pin is mounted on the inflator for movement toward the capsule.

3. The apparatus of claim 2, wherein the latching unit has an annular outer rim, the skirt of the cap is telescoped over the sleeve, and comprising inter-fitting polarizing male and female formations on the rim of the latching unit and the inner side wall of the sleeve portion of the housing to permit the latching unit to be mounted in the sleeve with only the one correct end of the latching unit confronting the base of the housing.

4. The apparatus of claim 1, wherein the resilient means is a coil compression spring, the sleeve portion, the skirt, and the threaded connection therebetween have such axial lengths that the sleeve and skirt may be initially threadedly connected without subjecting the coil compression spring to appreciable axial compression, and the spring can thereafter be compressed to cock the plunger by manually further screwing the cap on the sleeve portion of the housing.

5. The apparatus of claim 4, wherein the plunger has a larger-diametered main portion and a reduced-diametered free axially inner end portion, a transverse shoulder on the plunger located at the junction between the main and free end portions of the plunger, the transverse shoulder cooperating with the latching unit selectively to retain the plunger in cocked condition with the spring compressed, and the reduced-diametered free end portion of the plunger is freely insertable within and removable from the latching unit in either the operative, cocked or the inoperative, uncocked condition of the latching unit.

6. The apparatus of claim 5, wherein the latching unit comprises a sleeve adapted to be telescoped about the free end of the plunger, the sleeve being made up of a plurality of axially extending segments having teeth on the inner surface thereof adapted to engage the transverse shoulder on the plunger when the latching unit is in its cocked condition, the segments of the sleeve being mounted for being swung radially outwardly to free the teeth from engagement with the transverse shoulder on the plunger, and a water-disintegrable ring disposed about the segments to hold the teeth thereon in engagement with the transverse shoulder on the plunger.

7. The apparatus of claim 1, wherein the inflator comprises a first member, the capsule-piercing pin is mounted on the first member, the gas capsule is fixedly mounted on the first member, the piercing pin moves relative to the first member and capsule, and the housing containing the plunger, the resilient means, and the latching mechanism constitutes a separate, second member which is removably attached to the first member.

8. The apparatus of claim 7, comprising means mounted on the first member for manually advancing the piercing pin, said last-named means being operable independently of the automatic water-responsive inflator means mounted on the second member, the automatic water-responsive inflator means being operable independently of the means for manually advancing the piercing pin.

9. The apparatus of claim 1, wherein the plunger has an enlargement thereon, the resilient means is a coil compression spring, the spring is telescoped over the outer end of the plunger and is disposed between the transverse cover portion of the cap and the enlargement on the plunger, and comprising means slidably connecting the plunger to the cap, whereby the plunger, spring, and cap are retained together as a unit when the cap is removed from the body of the inflator.

10. The apparatus of claim 9, wherein the means slidably connecting the plunger to the cap comprises a centrally axially inwardly extending tubular member secured to the transverse cover portion of the cap, an annular radially inwardly extending flange having a central opening therethrough on the axially inner end of the tubular member, the plunger having an axially outer end slidingly and guidingly received through the central opening in the flange, the axially outer end of the plunger bearing a guide member having an outer diameter larger than the diameter of the opening in the flange and cooperating with the inner surface of the tubular member to guide the plunger, the guide member retaining the plunger, spring, and cap together as a unit when the cap is removed from the body of the inflator.

11. The apparatus of claim 10, wherein the guide member is made separate from the plunger and is mounted on the plunger after assembly of the plunger, spring, and cap.

12. The apparatus of claim 10, wherein the coil compression spring is telescoped over the tubular member which extends axially inwardly from the cover portion of the cap.

13. Apparatus according to claim 12, wherein the latching unit comprises a sleeve adapted to telescopically receive the free end of the plunger therewithin, the sleeve being made up of a plurality of axially extending segments having teeth on the inner surface thereof in engagement with a transverse shoulder on the plunger when the plunger and piercing pin are in the cocked position relative to each other, the segments of the sleeve being mounted for being swung radially outwardly to free the teeth from engagement with the transverse shoulder, a water-destructible ring disposed around the segments to hold the teeth thereon in engagement with the transverse shoulder on the plunger, and means engaging the outer surface of the ring in locations between the segments of the sleeve to hold the ring in compression in the spans thereof between such means and successive segments of the sleeve.

* * * * *